US012414636B2

(12) United States Patent
Ohno et al.

(10) Patent No.: US 12,414,636 B2
(45) **Date of Patent: *Sep. 16, 2025**

(54) AIR MATTRESS

(71) Applicant: Paramount Bed Co., Ltd., Tokyo (JP)

(72) Inventors: Kenta Ohno, Tokyo (JP); Hidekazu Nagai, Tokyo (JP)

(73) Assignee: Paramount Bed Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 18/417,289

(22) Filed: Jan. 19, 2024

(65) Prior Publication Data

US 2024/0225301 A1 Jul. 11, 2024

Related U.S. Application Data

(63) Continuation of application No. 17/055,440, filed as application No. PCT/JP2019/023859 on Jun. 17, 2019, now Pat. No. 11,910,928.

(30) Foreign Application Priority Data

Jan. 15, 2019 (JP) ..... 2019-004772
May 29, 2019 (JP) ..... 2019-100225

(51) Int. Cl.
*A47C 27/08* (2006.01)
*A47C 27/10* (2006.01)

(52) U.S. Cl.
CPC ..... *A47C 27/083* (2013.01); *A47C 27/10* (2013.01)

(58) Field of Classification Search
CPC ..... A47C 27/08; A47C 27/082; A47C 27/083; A47C 27/084; A47C 27/087; A47C 27/088; A47C 27/10
See application file for complete search history.

(56) References Cited

U.S. PATENT DOCUMENTS 5,020,176 A * 6/1991 Dotson ..... A47C 27/18 5/672
6,384,715 B1 * 5/2002 Potter ..... B60N 2/0248 340/407.1

(Continued)

FOREIGN PATENT DOCUMENTS

CN 1893862 A 1/2007
CN 103561613 A 2/2014

(Continued)

OTHER PUBLICATIONS

International Search Report dated Jul. 17, 2019, mailed in counterpart International Application No. PCT/JP2019/023859, 7 pages.

*Primary Examiner* — George Sun
(74) *Attorney, Agent, or Firm* — Kim & Stewart LLP

(57) ABSTRACT

According to embodiments, an air mattress includes an air cell unit and a controller. The air cell unit includes a first air cell and a second air cell. The controller is capable of independently controlling a first internal pressure in the first air cell and a second internal pressure in the second air cell. The controller performs, when receiving an input to change the second internal pressure, after a first operation to set the first internal pressure to a first set internal pressure determined related to the first air cell, a second operation to change the second internal pressure.

20 Claims, 11 Drawing Sheets

(56) References Cited

U.S. PATENT DOCUMENTS

| | | | | |
|---|---|---|---|---|
| 2002/0148045 | A1* | 10/2002 | Giori | A47C 27/15 5/709 |
| 2007/0094806 | A1* | 5/2007 | Beretta | A47C 27/083 5/713 |
| 2012/0291204 | A1* | 11/2012 | Takeda | A61G 7/0527 5/710 |
| 2012/0317727 | A1* | 12/2012 | Tanaka | A61G 7/057 5/710 |
| 2014/0101861 | A1* | 4/2014 | Gowda | A61G 7/05792 5/709 |
| 2014/0101862 | A1* | 4/2014 | Misaki | A61G 7/05769 5/710 |
| 2015/0026896 | A1* | 1/2015 | Fleury | A47C 27/082 5/713 |
| 2016/0270547 | A1* | 9/2016 | Liu | A47C 27/08 |
| 2017/0035212 | A1* | 2/2017 | Erko | A47C 27/082 |
| 2017/0086598 | A1* | 3/2017 | Ohno | A47C 27/083 |
| 2017/0251823 | A1* | 9/2017 | Nakamura | A47C 27/082 |
| 2019/0021513 | A1* | 1/2019 | Nunn | A47C 27/082 |
| 2019/0142180 | A1* | 5/2019 | Huang | A47C 27/084 5/710 |

FOREIGN PATENT DOCUMENTS

| | | | |
|---|---|---|---|
| JP | H03-23813 | A | 1/1991 |
| JP | H04-9114 | A | 1/1992 |
| JP | 2011-160892 | A | 8/2011 |
| WO | 2020/148928 | A1 | 7/2020 |

* cited by examiner

AIR MATTRESS

CROSS-REFERENCE TO RELATED APPLICATIONS

This application is a continuation of U.S. patent application Ser. No. 17/055,440, filed Nov. 13, 2020, which is a national stage application, filed under 35 U.S.C. § 371, of International Patent Application No. PCT/JP2019/023859, filed Jun. 17, 2019, which is based upon and claims the benefit of priority from Japanese Patent Application No. 2019-100225, filed May 29, 2019, and Japanese Patent Application No. 2019-004772, filed Jan. 15, 2019, each of which is incorporated by reference herein in its entirety.

TECHNICAL FIELD

Embodiments of the present invention relate to an air mattress.

BACKGROUND ART

There are air mattresses in which air cells are used. The air mattresses are desired to be more comfortable.

CITATION LIST

Patent Literature

PTL 1: JP-A-2011-160892

SUMMARY OF INVENTION

Technical Problem

Embodiments of the present invention provide a more comfortable air mattress.

Solution to Problem

According to the embodiments, an air mattress includes an air cell unit and a controller. The air cell unit includes a first air cell and a second air cell. The controller is capable of independently controlling a first internal pressure in the first air cell and a second internal pressure in the second air cell. The controller performs, when receiving an input to change the second internal pressure, after a first operation to set the first internal pressure to a first set internal pressure determined related to the first air cell, a second operation to change the second internal pressure.

Advantageous Effects of Invention

The embodiments of the present invention can provide a more comfortable air mattress.

DESCRIPTION OF EMBODIMENTS

Figure 1A:
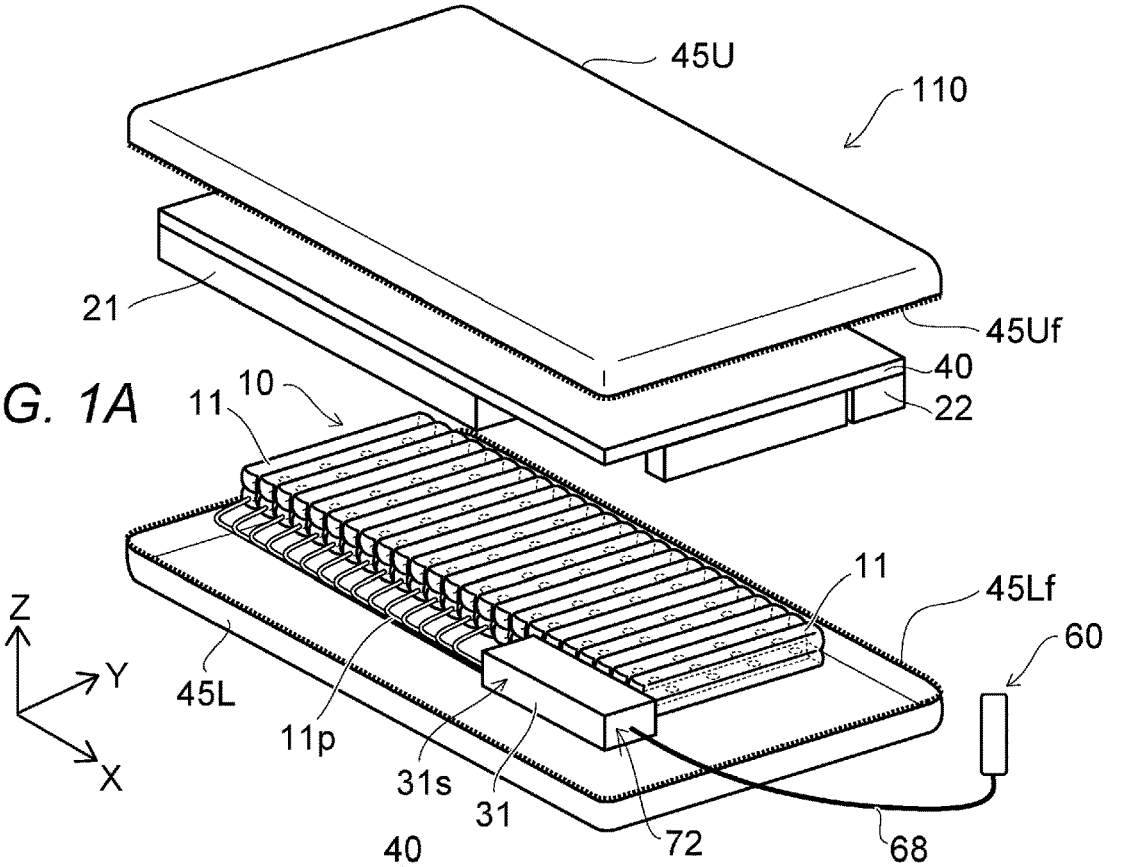
FIGS. 1A to 1D are schematic views exemplifying an air mattress according to an embodiment.

Hereinafter, embodiments of the invention will be described with reference to the drawings.

The drawings are schematic or conceptual, and the relation between the thickness and the width in each portion, and the ratio of the sizes between portions, and the like are not necessarily the same as actual ones.

Even when the same portion is illustrated, the same portion is illustrated mutually differently in the size and the ratio depending on the drawing in some cases.

In the specification of the present application and the respective drawings, the similar elements having been described related to the already described drawing are assigned with the same reference numerals, and detailed explanations thereof are omitted as appropriate.

First Embodiment

FIGS. 1A to 1D are schematic views exemplifying an air mattress according to an embodiment.

Figure 1B:
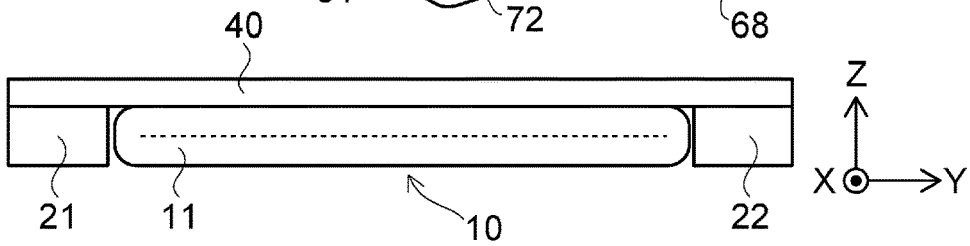
Figure 1C:
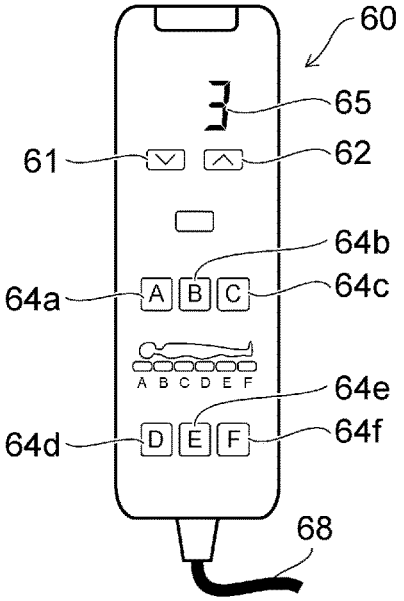
Figure 1D:
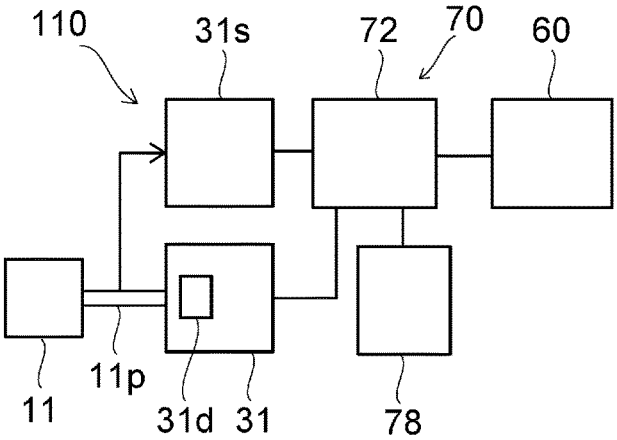

FIG. 1A is a perspective view exemplifying a plurality of elements that are included in an air mattress 110 according to the embodiment. In FIG. 1A, for easy recognition of the drawing, the plurality of the elements are illustrated by being separated from one another. FIG. 1B is a cross-sectional view. FIG. 1C is a plan view exemplifying a user interface device 60 of the air mattress 110. FIG. 1D is a function block diagram of the air mattress 110.

As illustrated in FIG. 1A, the air mattress 110 according to the embodiment includes a plurality of air cells 11 and a controller 72. The plurality of the air cells 11 are included in an air cell unit 10. The plurality of the air cells 11 each are, for example, tubular.

The plurality of the air cells 11 are arranged along a first direction. An X axis direction is set as the first direction. One direction perpendicular to the X axis direction is set as a Z axis direction. A direction perpendicular to the X axis direction and the Z axis direction is set as a Y axis direction.

The first direction corresponds to, for example, a direction from the head to the legs when a user is laid on the air mattress 110. The Y axis direction corresponds to a right-and-left direction. The Z axis direction corresponds to a direction from a lower surface to an upper surface of the air mattress 110.

As illustrated in FIGS. 1A and 1B, in this example, an upper layer cushion unit 40 is provided on the air cell unit 10 (on the air cells 11). In the Y axis direction, the air cell unit 10 is provided between a first side edge unit 21 and a second side edge unit 22. The upper layer cushion unit 40, the first side edge unit 21, and the second side edge unit 22 include, for example, a polymeric foam. The polymeric foam includes, for example, an urethane foam. The polymeric foam includes a plurality of holes.

As illustrated in FIG. 1A, in the Z axis direction (up-and-down direction), between a top cover 45U and a section cover 45L, the air cell unit 10, the upper layer cushion unit 40, the first side edge unit 21, and the second side edge unit 22 are provided. In one example, the top cover 45U and the section cover 45L include materials such as polyester. A zipper 45Uf of the top cover 45U and a zipper 45Lf of the section cover 45L connect these covers.

As illustrated in FIG. 1A, the air mattress 110 further includes a pump unit 31. The pump unit 31 is connected to the plurality of the air cells 11 respectively through tubes 11*p*. The pump unit 31 performs supply and exhaust of air to and from the plurality of the air cells 11.

In the example illustrated in FIG. 1A, the controller 72 is provided in a housing of the pump unit 31. The controller 72 may include, for example, a processor.

As illustrated in FIG. 1D, the controller 72 is connected to the pump unit 31. At least either arbitrary method of wired and wireless methods is applicable to the connection (for example, communication) between the controller 72 and the pump unit 31. The controller 72 controls the pump unit 31. The internal pressures in the plurality of the air cells 11 are controlled by an operation of the pump unit 31.

For example, a sensor 31*s* may be provided. For example, the sensor 31*s* is capable of detecting the internal pressures in the plurality of the air cells 11. In one example, the internal pressures in the tubes 11*p* that are respectively connected to the plurality of the air cells 11 are detected, so that the respective internal pressures in the plurality of the air cells 11 can be detected. For example, the controller 72 may control the internal pressures to be in a desired state on the basis of the detected internal pressures.

As illustrated in FIGS. 1A and 1D, the air mattress 110 may further include the user interface device 60. The user interface device 60 receives an input by a user. The user interface device 60 is, for example, an operation switch (for example, a remote controller). The controller 72 controls the internal pressures in the plurality of the air cells 11 in accordance with the input received by the user interface device 60. The user interface device 60 is connected to the controller 72 (or the pump unit 31) by at least either arbitrary method of wired and wireless methods. In this example, the user interface device 60 is connected to the controller 72 (or the pump unit 31) by a cable 68.

Figure 2A:
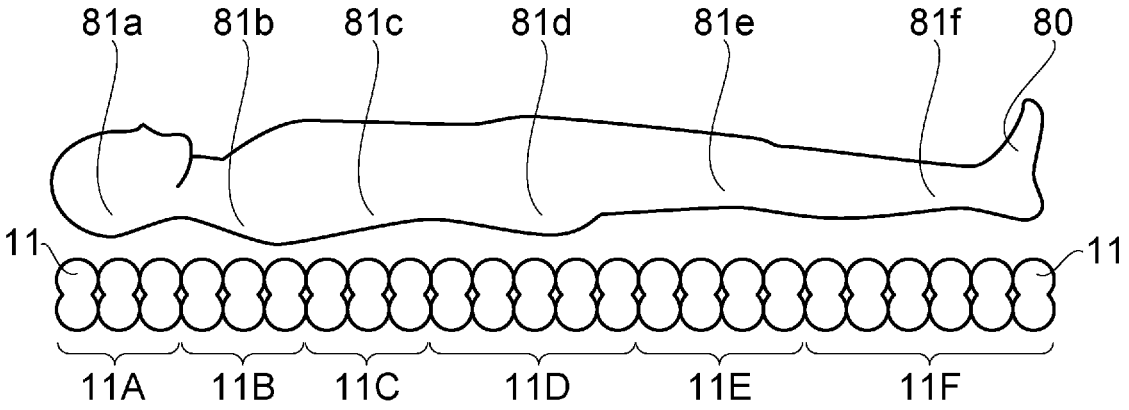
FIGS. 2A and 2B are schematic views exemplifying an operation in the air mattress according to the embodiment.
Figure 2B:
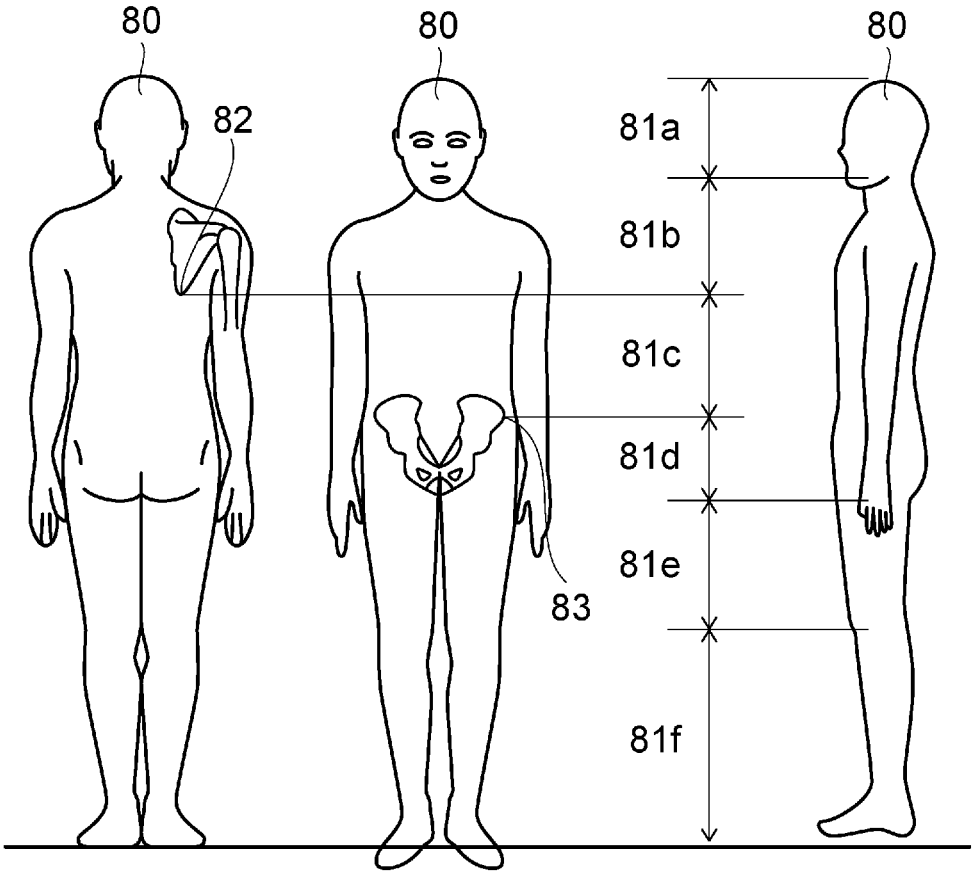

FIGS. 2A and 2B are schematic views exemplifying an operation in the air mattress according to the embodiment.

As illustrated in FIG. 2A, the plurality of the air cells 11 are capable of being controlled by being divided into a plurality of blocks. In this example, the plurality of the air cells 11 are divided into a head block 11A, a shoulder block 11B, a hip block 11C, a buttock block 11D, an upper leg block 11E, and a lower leg block 11F. The number of the plurality of the blocks is an arbitrary integer of 2 or more.

In this example, the plurality of the blocks respectively include the plurality of the air cells 11. The case where the number of the air cells 11 included in one of the plurality of the blocks is 1 may be employed.

The head block 11A corresponds to, for example, a head part 81*a* of a user 80. The shoulder block 11B corresponds to, for example, a shoulder part 81*b* of the user 80. The hip block 11C corresponds to, for example, a hip part 81*c* of the user 80. The buttock block 11D corresponds to, for example, a buttock part 81*d* of the user 80. The upper leg block 11E corresponds to, for example, an upper leg part 81*e* of the user 80. The lower leg block 11F corresponds to, for example, a lower leg part 81*f* of the user 80.

As illustrated in FIG. 2B, a shoulder blade-inferior tip 82 of the user 80 corresponds to a boundary between the shoulder part 81*b* and the hip part 81*c*. An iliac crest protrusion-inferior tip 83 of the user 80 corresponds to a boundary between the hip part 81*c* and the buttock part 81*d*.

In the embodiment, the controller 72 is capable of independently controlling the internal pressures of a part (one block) of the plurality of the air cells 11 and the internal pressure of another part (another block) of the plurality of the air cells 11.

For example, the controller 72 is capable of independently controlling the respective internal pressures in the head block 11A, the shoulder block 11B, the hip block 11C, the buttock block 11D, the upper leg block 11E, and the lower leg block 11F.

For example, as illustrated in FIG. 1C, respective display input units 64*a* to 64*f* of "A", "B", "C", "D", "E", and "F" are provided to a manipulation surface of the user interface device 60. "A", "B", "C", "D", "E", and "F" respectively correspond to the head block 11A, the shoulder block 11B, the hip block 11C, the buttock block 11D, the upper leg block 11E, and the lower leg block 11F. The display input units 64*a* to 64*f* have a function to receive inputs, in addition to the display function.

For example, when the user presses the display input unit 64*a*, the brightness of the display input unit 64*a* becomes brighter than the brightness of the others. In this state, the display input unit 64*a* allows an input reception. In this state, when the user 80 presses an "ascending button 62", the internal pressure in the head block 11A corresponding to "A" rises. On the other hand, in this state, when the user 80 presses a "descending button 61", the internal pressure in the head block 11A corresponding to "A" decreases. A value corresponding to the internal pressure may be displayed on a display 65 (see FIG. 1C) of the user interface device 60. In the control of the internal pressure in the head block 11A, the internal pressures in the other blocks do not substantially change.

After the user 80 was able to set a desired internal pressure, when the user presses the display input unit 64*a* or a determined time has elapsed, the display input unit 64*a* becomes a state of not receiving an input. Such an operation is also applied to the display input units 64*b* to 64*f*.

In the embodiment, the internal pressures in the plurality of the blocks are capable of being independently controlled. This can provide good comfort.

In this manner, the air cell unit 10 includes a first air cell block and a second air cell block. The first air cell block includes a plurality of the air cells 11. The second air cell block includes another plurality of the air cells 11. The first air cell block is, for example, one of the head block 11A, the shoulder block 11B, the hip block 11C, the buttock block 11D, the upper leg block 11E, and the lower leg block 11F. The second air cell block is, for example, another one of the head block 11A, the shoulder block 11B, the hip block 11C, the buttock block 11D, the upper leg block 11E, and the lower leg block 11F. The controller 72 is capable of independently controlling a first internal pressure in the first air cell block and a second internal pressure in the second air cell block. Good comfort can be provided.

For example, there is a reference example in which the internal pressures in all the air cells 11 that are included in the air cell unit 10 are simultaneously changed. In contrast, in the air mattress 110 according to the embodiment, the internal pressures in the plurality of the blocks are capable of being independently controlled. This can provide a more comfortable posture compared with the reference example. In the embodiment, a more comfortable air mattress can be provided.

In the embodiment, for example, "sleep comfort" can be changed in accordance with a status (for example, low back pain and the like) of the user 80. In the embodiment, the "sleep comfort" can be adjusted.

For example, when the user is sleeping, the buttock part 81*d* is likely to sink, and the shoulder part 81*b* is unlikely to sink. In the embodiment, "sinking" in accordance with a preference of the user can be obtained. For example, a sleep posture is stabilized.

In the embodiment, all the respective air cells 11 that are included in the air cell unit 10 are not individually adjusted, but are adjusted as blocks. Therefore, the adjustment in accordance with the preference is easy.

In one example, the first air cell block may be one of the hip block 11C and the lower leg block 11F, and the second air cell block may be the other of the hip block 11C and the lower leg block 11F. In this case, the posture of the lower body is likely to be adjusted.

The first air cell block is one of the shoulder block 11B and the hip block 11C, and the second air cell block is the other of the shoulder block 11B and the hip block 11C. In this case, the posture of the upper body is likely to be adjusted.

In the embodiment, in addition, the internal pressures in the plurality of all the air cells 11 that are included in the air cell unit 10 may be capable of being simultaneously controlled. For example, in FIG. 1C, in a state where the display input units 64*a* to 64*f* are dark and are not an input reception state, when the "ascending button 62" is pressed, the internal pressures in all the air cells 11 rise. On the other hand, in this state, when the "descending button 61" is pressed, the internal pressures in all the air cells 11 lower. Such an operation allows the overall hardness to be easily and collectively controlled.

Figure 3A:
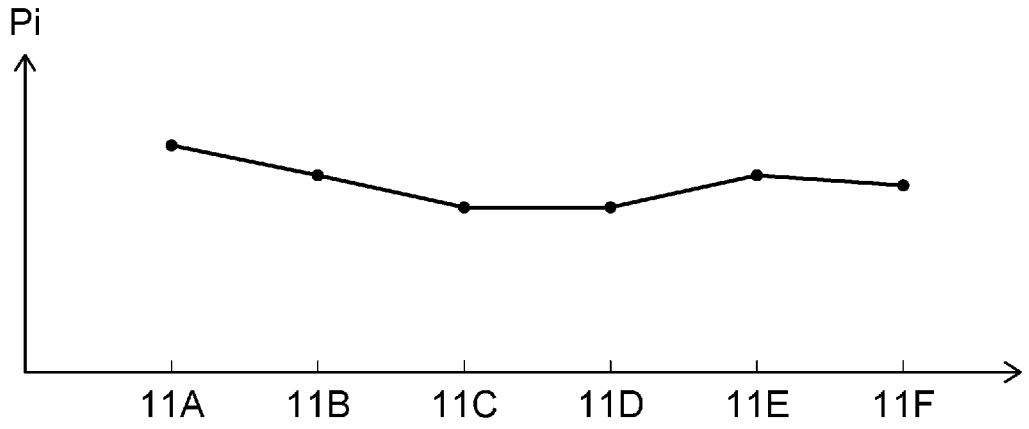
FIGS. 3A and 3B are schematic views exemplifying an operation in the air mattress according to the embodiment.
Figure 3B:
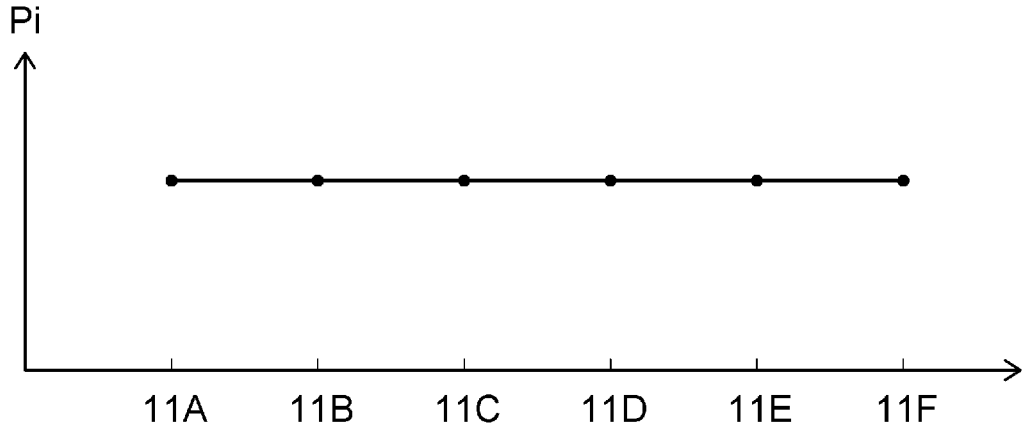

FIGS. 3A and 3B are schematic views exemplifying an operation in the air mattress according to the embodiment.

These drawings exemplify the internal pressures in the plurality of the air cell blocks. The horizontal axis in these figures corresponds to the head block 11A, the shoulder block 11B, the hip block 11C, the buttock block 11D, the upper leg block 11E, and the lower leg block 11F. The longitudinal axis corresponds to internal pressures Pi of the respective blocks. As illustrated in FIGS. 3A and 3B, the internal pressures Pi in the plurality of the blocks are capable of being independently controlled.

In a first example of setting of the internal pressures Pi, the internal pressure Pi of the head block 11A is 8 kPa, the internal pressure Pi of the shoulder block 11B is 8 kPa, the internal pressure Pi of the hip block 11C is 7 kPa, the internal pressure Pi of the buttock block 11D is 8 kPa, the internal pressure Pi of the upper leg block 11E is 4 kPa, and the internal pressure Pi of the lower leg block 11F is 4 kPa.

In a second example of setting of the internal pressures Pi, the internal pressure Pi of the head block 11A is 6 kPa, the internal pressure Pi of the shoulder block 11B is 6 kPa, the internal pressure Pi of the hip block 11C is 5 kPa, the internal pressure Pi of the buttock block 11D is 6 kPa, the internal pressure Pi of the upper leg block 11E is 3 kPa, and the internal pressure Pi of the lower leg block 11F is 3 kPa.

In a third example of setting of the internal pressures Pi, the internal pressure Pi of the head block 11A is 4 kPa, the internal pressure Pi of the shoulder block 11B is 4 kPa, the internal pressure Pi of the hip block 11C is 3 kPa, the internal pressure Pi of the buttock block 11D is 4 kPa, the internal pressure Pi of the upper leg block 11E is 2 kPa, and the internal pressure Pi of the lower leg block 11F is 2 kPa.

The first example corresponds to, for example, a "hard" setting. The second example corresponds to, for example, "medium" setting. The third example corresponds to, for example, "soft" setting.

For example, the sinking in the hip part is generally less because the hip part has bones less than those in the other portions. In the embodiment, for example, the air cells 11 in the hip part are set to be softer than those in the other portions. Accordingly, when the shoulders and the buttocks are sunk in a lateral decubitus position, discomfort feeling in the flank is suppressed. For example, the air cells in the thighs and the lower legs are made to be softer than the other portions, so that good balance can be obtained.

In the embodiment, in the plurality of the air cells 11 (or the plurality of the blocks), set values of the internal pressures Pi may be initially set. For example, data related to the distribution of the internal pressures that the user prefers may be stored. The data is stored in a memory 78 (see FIG. 1D), for example. The controller 72 may control the internal pressures Pi in the plurality of the air cells 11 on the basis of the data stored in the memory 78. The data may include a time change in the internal pressure Pi. The controller 72 may control the respective internal pressures Pi in the plurality of the air cells 11 (plurality of the blocks) so as to change in terms of time.

In the embodiment, the pump unit 31 may include a DC pump 31*d* (see FIG. 1D). By using the DC pump 31*d*, for example, pulse width modulation (PWM) control may be conducted. Hereinafter, an example of the PWM control will be described.

Figure 4A:
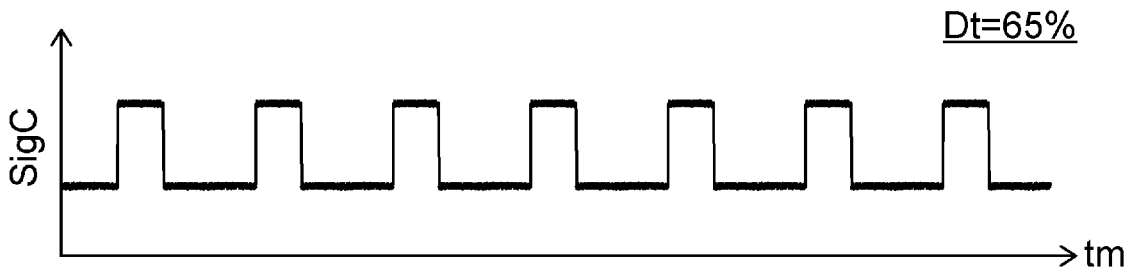
FIGS. 4A and 4B are schematic views exemplifying an operation in the air mattress according to the embodiment.
Figure 4B:
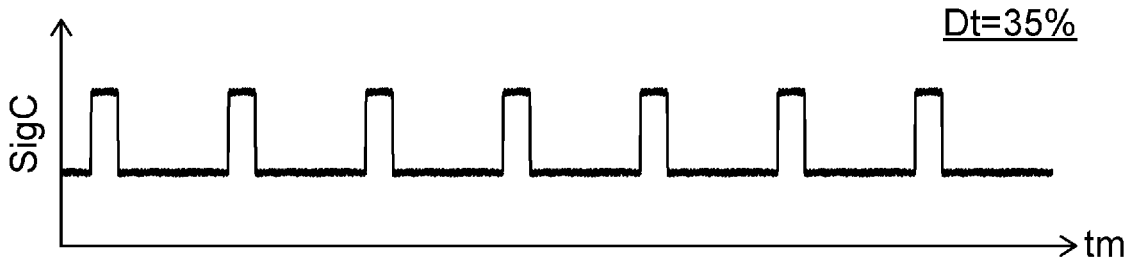

FIGS. 4A and 4B are schematic views exemplifying an operation in the air mattress according to the embodiment.

The horizontal axis in these drawings represents time tm. The longitudinal axis exemplifies strength SigC of the PWM control signal. FIG. 4A corresponds to a case where a duty ratio Dt is 65%. FIG. 4B corresponds to a case where the duty ratio Dt is 35%. The PWM control signal is supplied, for example, from the controller 72 or a drive circuit controlled by the controller 72, to the DC pump 31*d*. The amount of supply and exhaust of air to and from the air cells 11 by the DC pump 31*d* can be controlled from a ratio of a period in a high state of the strength SigC of the PWM control signal and a period in a low state of the strength SigC thereof.

Figure 5:
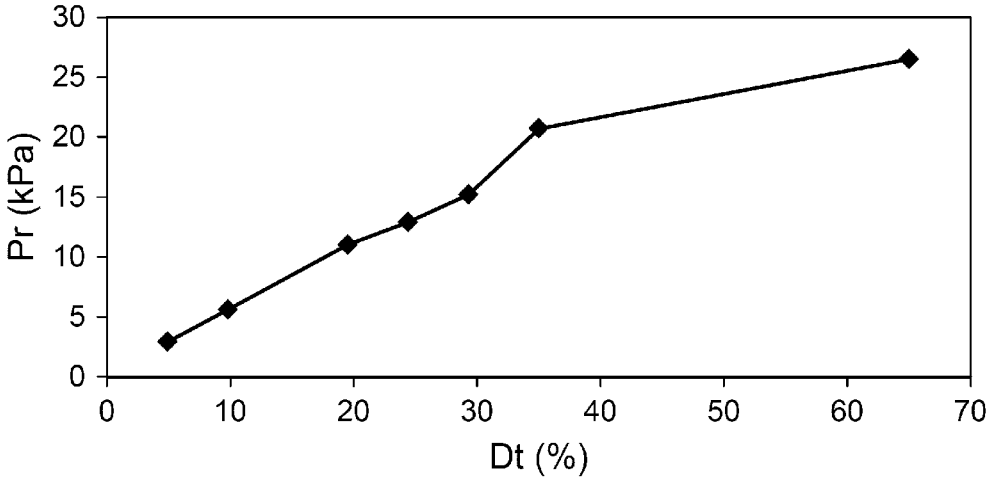
FIG. 5 is a graph exemplifying the operation in the air mattress according to the embodiment.

FIG. 5 is a graph exemplifying an operation in the air mattress according to the embodiment.

The horizontal axis in FIG. 5 represents the duty ratio Dt. The longitudinal axis represents a pressure Pr (kPa) in the supply and exhaust of air. As illustrated in FIG. 5, when the duty ratio Dt is high, the pressure Pr in the supply and exhaust of air becomes high. The duty ratio Dt in the PWM control is controlled to allow the amount of the supply and exhaust of air to and from the pump to be controlled.

In the embodiment, the pump unit 31 may include an AC pump. The internal pressures in the air cells 11 can be controlled by an operation of the AC pump. In this case, for example, by an applied voltage to the AC pump, an output (for example, the pressure Pr in the supply and exhaust of air) from the AC pump is controlled. In the AC pump, the applied voltage can be switched by phase control. In the phase control, a desired operation is unlikely to be obtained because an influence of the fluctuation in the frequency is received in some cases.

With the PWM control that uses the DC pump, for example, the output can be controlled with high accuracy in accordance with the pressure of the necessary supply and exhaust of air without substantially receiving an influence due to the variation of the AC power supply (for example, including the fluctuation in the frequency and the like). For example, the output can be minimized. With the PWM control that uses the DC pump, for example, compared with the case where the AC pump is used, sound to be generated can be made low. For example, the sound to be generated can be minimized. Accordingly, for example, better sleep comfort can be provided.

Hereinafter, an example of an operation of the air mattress 110 will be described.

Figure 6:
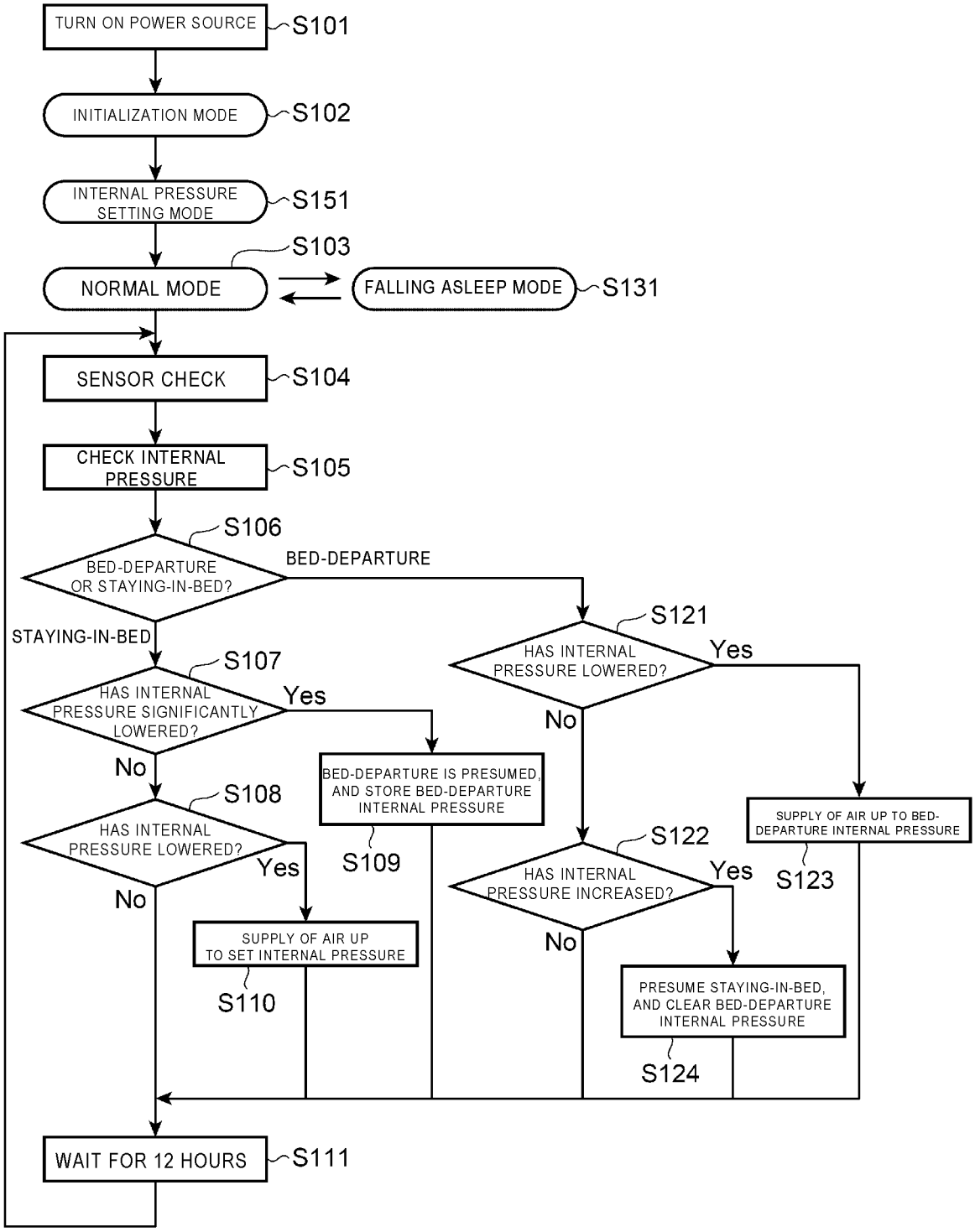
FIG. 6 is a flowchart exemplifying the operation in the air mattress according to the embodiment.

FIG. 6 is a flowchart exemplifying the operation in the air mattress according to the embodiment.

As illustrated in FIG. 6, a power supply is turned on (Step S101). Accordingly, for example, the operation is shifted to an initialization mode (Step S102). In the initialization mode, for example, the internal pressure (the pressure Pr) in the air cells 11 is set to a fixed value (for example, 5 kPa and the like). In the initialization mode, the user 80 gets on the air cell unit 10. For example, in this state, the internal pressure (the pressure Pr) is set to a fixed value.

In the embodiment, the operation is shifted to an internal pressure setting mode (Step S151). In the internal pressure setting mode, for example, the respective internal pressures in the plurality of the blocks are capable of being set. For example, an internal pressure of at least one among the head block 11A, the shoulder block 11B, the hip block 11C, the buttock block 11D, the upper leg block 11E, and the lower leg block 11F is set. Two internal pressures in the plurality of these blocks are capable of being independently controlled. The control of the internal pressure is performed by the controller 72, for example, on the basis of a manipulation (input) by the user or the like received by the user interface device 60.

The operation is shifted to a normal mode (Step S103). For example, on the basis of a state of the user 80 or on the basis of the reception of a manipulation by the user interface device 60, the operation may be shifted to a falling asleep mode (Step S131). In the falling asleep mode (Step S131), on the basis of the reception of a manipulation of an "end", on the basis of a state of the user 80, or on the basis of the reception of a manipulation by the user interface device 60, the operation returns to the normal mode (Step S103).

In the normal mode, for example, a sensor check is conducted (Step S104). The internal pressure is checked (detected) (Step S105). In addition, at this time, it is determined whether a set (stored) state is "bed-departure" or "staying-in-bed" (Step S106). The "set (stored) state" is, for example, a state when a previous operation has ended (for example, Step S111, which is described later). For example, a state of the air mattress 110 that is set (stored) at the beginning may be "staying-in-bed", for example. At Step S106, if the state is "bed-departure", the operation proceeds to Step S121, which is described later. If the state is "staying-in-bed", the operation proceeds to Step S107.

At Step S107, it is determined whether the internal pressure has significantly lowered. If it has been determined that the internal pressure has significantly lowered, "bed-departure" is presumed, and the internal pressure at that time is stored as a "bed-departure internal pressure" (Step S109). Thereafter, for example, the operation waits for a fixed time (for example, 12 hours), (Step S111).

At Step S107, if it has been determined that the internal pressure has not significantly lowered, it is determined whether the internal pressure has lowered (Step S108). If it has been determined that the internal pressure has not lowered, the operation proceeds to Step S111.

If it has been determined that the internal pressure has lowered at Step S108, supply of air up to the set internal pressure is performed (Step S110). Thereafter, the operation proceeds to Step S111.

At Step S106, if it has been determined as "bed-departure", it is determined whether the internal pressure has lowered at Step S121. If it has been determined that the internal pressure has not lowered, it is determined whether the internal pressure has increased (Step S122). If it has been determined that the internal pressure has not increased, the operation proceeds to Step S111. If it has been determined that internal pressure has increased, "staying-in-bed" is presumed, and the "bed-departure internal pressure" is cleared (Step S124, for example, the memory is initialized). Thereafter, the operation proceeds to Step S111.

At Step S121, if it has been determined that the internal pressure has lowered, supply of air up to the "bed-departure internal pressure" is performed (Step S123). Thereafter, the operation proceeds to Step S111.

Such an operation is performed by, for example, a control device 70 (see FIG. 1D, or the controller 72) or the like. The abovementioned plurality of steps may be switched within a technically possible range.

Second Embodiment

Figure 7:
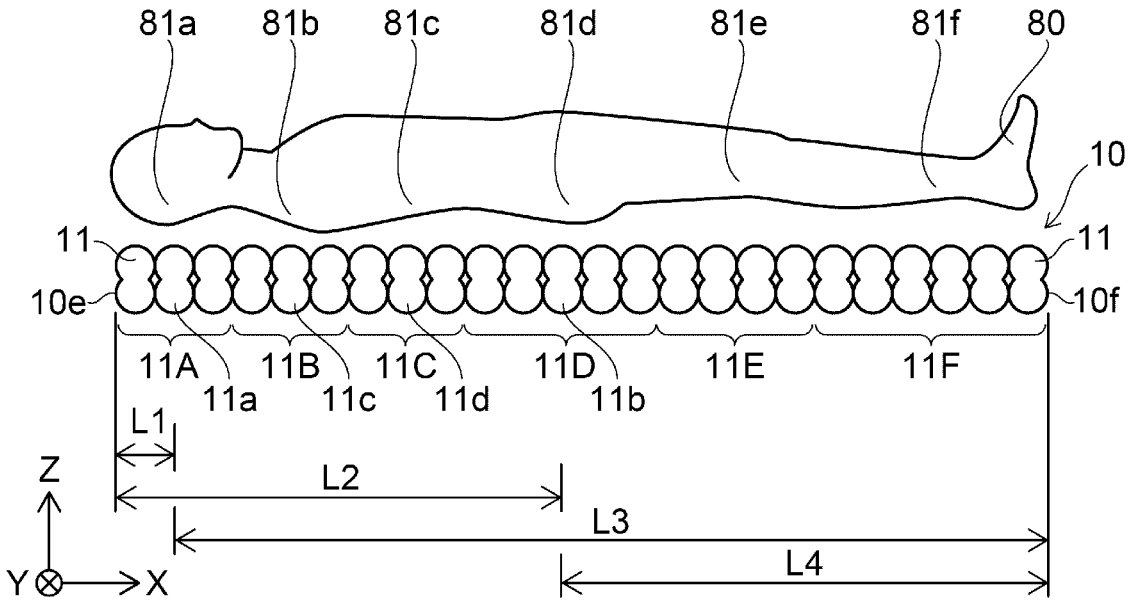
FIG. 7 is a schematic side view exemplifying an air mattress according to an embodiment.

FIG. 7 is a schematic side view exemplifying an air mattress according to an embodiment. As illustrated in FIG. 7, the air cell unit 10 includes the plurality of the air cells 11. The air cell unit 10 includes, for example, a first air cell 11*a* and a second air cell 11*b*. The air cell unit 10 may further include, for example, a third air cell 11*c* and a fourth air cell 11*d*.

The third air cell 11*c* is present between the first air cell 11*a* and the second air cell 11*b*. The fourth air cell 11*d* is present between the third air cell 11*c* and the second air cell 11*b*.

The first air cell 11*a* is, for example, an air cell for the head. the second air cell 11*b* is, for example, an air cell for the buttocks. The third air cell 11*c* is, for example, an air cell for the shoulders. The fourth air cell 11*d* is, for example, an air cell for the hip.

The first air cell 11*a* is included, for example, in the head block 11A. The second air cell 11*b* is included, for example, in the buttock block 11D. The third air cell 11*c* is included, for example, in the shoulder block 11B. The fourth air cell 11*d* is included, for example, in the hip block 11C.

For example, the air cell unit 10 includes a first end 10*e* and a second end 10*f*. The first end 10*e* is an end portion at a head side. The second end 10*f* is an end portion at a feet side. The first direction from the first end 10*e* to the second end 10*f* is along a direction from the first air cell 11*a* to the second air cell 11*b*. The first direction is, for example, the X axis direction.

As illustrated in FIG. 7, a distance along the first direction (the X axis direction) between the first end 10*e* and the first air cell 11*a* is set as a first distance L1. A distance along the first direction between the first end 10*e* and the second air cell 11*b* is set as a second distance L2. The first distance L1 is shorter than the second distance L2.

A distance along the first direction between the second end 10*f* and the first air cell 11*a* is set as a third distance L3. A distance along the first direction between the second end 10*f* and the second air cell 11*b* is set as a fourth distance L4.

The third distance L3 is longer than the fourth distance L4. For example, the third distance L3 is longer than the second distance L2. The fourth distance L4 is longer than the first distance L1.

In a case where such the first air cell 11*a* and the second air cell 11*b* are provided, in the embodiment, the following operation is performed. The following operation is conducted under the control by the controller 72 (see FIG. 1D, or the control device 70). The controller 72 is capable of independently controlling a first internal pressure in the first air cell 11*a* and a second internal pressure in the second air cell 11*b*. The controller 72 is capable of controlling a third internal pressure in the third air cell 11*c*, independently of the first internal pressure and the second internal pressure. The controller 72 is capable of controlling a fourth internal pressure in the fourth air cell 11*d*, independently of the first internal pressure, the second internal pressure, and the third internal pressure.

Figure 8:
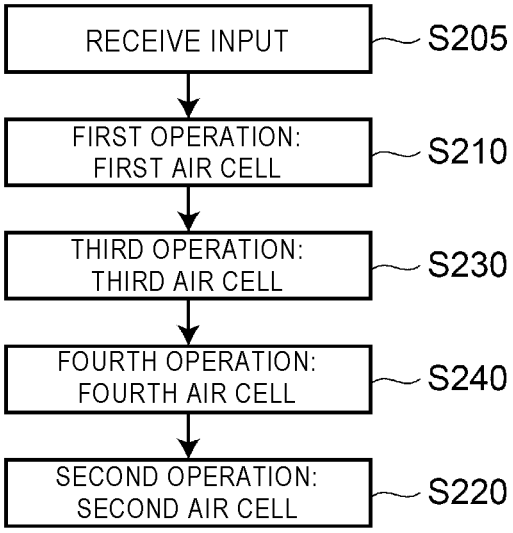
FIG. 8 is a flowchart exemplifying an operation of the air mattress according to the embodiment.

FIG. 8 is a flowchart exemplifying an operation of the air mattress according to the embodiment.

As illustrated in FIG. 8, the controller 72 receives an input to change the second internal pressure (Step S205). The user 80 manipulates the display input unit 64*d* of the user interface device 60 (see FIG. 1C) to cause the display input unit 64*d* to be in a selection state. Thereafter, the user 80 presses the "descending button 61" or the "ascending button 62". In this manner, a manipulation to lower or increase the internal pressure in the buttock block 11D (the second air cell 11*b*) is performed.

The user interface device 60 receives such an input by the user 80. A signal corresponding to the reception of the input by the user interface device 60 is supplied to the controller 72. In this manner, the controller 72 receives the input to change the second internal pressure.

As illustrated in FIG. 8, if the controller 72 has received the input to change the second internal pressure (Step S205), the controller 72 performs a second operation (Step S220) after a first operation (Step S210). As illustrated in FIG. 7, between the first operation and the second operation, a third operation, a fourth operation, and the like, which are described later, may be performed.

In the first operation, the controller 72 sets the first internal pressure in the first air cell 11*a* (current internal pressure) to a first set internal pressure determined related to the first air cell 11*a*.

In the second operation, the controller 72 changes the second internal pressure in the second air cell 11*b* to a target internal pressure. The target internal pressure is an internal pressure that is intended to be changed.

For example, before the second operation in which the second internal pressure in the second air cell 11*b* that is included in the buttock block 11D is changed, a manipulation of the first air cell 11*a* (for example, the head block 11A) that is closer to the head side than the buttock block 11D is performed. In a case where the first internal pressure in the first air cell 11*a* is not the first set internal pressure, the controller 72 performs supply of air or exhaust of air with respect to the first air cell 11*a* so as to cause the first internal pressure to be the first set internal pressure. For example, it has been understood that before supply and exhaust of air is performed to and from an air cell at the buttocks side (may be the feet side), a manipulation (supply and exhaust of air) is performed to and from an air cell at the head side to reduce discomfort feeling of the user 80. A more comfortable air mattress can be provided.

As is described later, for example, in a case where the third air cell 11*c*, the fourth air cell 11*d*, and the like are provided between the first air cell 11*a* and the second air cell 11*b*, the manipulation (supply and exhaust of air) of the air cells is performed in sequence from the head side toward the buttocks side (from the head side to the feet side). This reduces the discomfort feeling of the user 80, and a more comfortable air mattress can be provided.

For example, the body weight of the user 80 is mainly applied to the second air cell 11*b* (for example, the buttock block 11D). The load (body weight) to be applied to the first air cell 11*a* (for example, the head block 11A) is comparatively small. In a case where the second internal pressure in the second air cell 11*b* is changed, it has been understood that when only the second internal pressure is changed, for example, a posture of the user 80 is likely to change and the discomfort feeling of the user 80 is large. In contrast, before the second internal pressure in the second air cell 11*b* is changed, supply and exhaust of air is performed to the first air cell 11*a* at the head side to reduce the change in the posture of the user 80, so that the discomfort feeling of the user 80 can be reduced.

The first air cell 11*a* corresponds to, for example, the head of the user 80. When the first internal pressure in the first air cell 11*a* changes, an angle of a neck of the user 80 sensitively changes. Therefore, when the first internal pressure in the first air cell 11*a* is shifted from the first set internal pressure, the posture in the head of the user 80 sensitively changes, and the discomfort feeling of the user 80 is large.

When the supply and exhaust of air is performed to the first air cell 11*a*, even in a case where the amount of supply and exhaust of air is small, the user 80 can sensitively feel the supply and exhaust of air. The supply and exhaust of air is performed to the first air cell 11*a* in a case where the second internal pressure in the second air cell 11*b* is changed, so that the supply and exhaust of air to the first air cell 11*a* serves as an advance notice of change in the second internal pressure in the second air cell 11*b*. The reception of an advance notice of change in the second internal pressure in the second air cell 11*b* can further reduce the discomfort feeling of the user 80.

As illustrated in FIG. 8, the controller 72 may further conduct the third operation (Step S230) between the first operation (Step S210) and the second operation (Step S220). In the third operation, the controller 72 sets the third internal pressure in the third air cell 11*c* to a third set internal pressure determined related to the third air cell 11*c*. For example, in a case where the third internal pressure is not the third set internal pressure, the controller 72 performs supply of air or exhaust of air with respect to the third air cell 11*c*.

As illustrated in FIG. 8, the controller 72 may further conduct the fourth operation (Step S240) between the third operation (Step S230) and the second operation (Step S220). In the fourth operation, the controller 72 sets the fourth internal pressure in the fourth air cell 11*d* to a fourth set internal pressure determined related to the fourth air cell 11*d*. For example, in a case where the fourth internal pressure is not the fourth set internal pressure, the controller 72 performs supply of air or exhaust of air with respect to the fourth air cell 11*d*.

For example, the manipulation (supply and exhaust of air) of the air cells is performed in sequence from the head side toward the buttock side (from the head side to the feet side), so that the discomfort feeling of the user 80 is reduced and a more comfortable air mattress can be provided.

The first set internal pressure is a set internal pressure related to the first air cell 11*a* before the internal pressure in the second air cell 11*b* is intended to change. The third set internal pressure is a set internal pressure related to the third air cell 11*c* before the internal pressure in the second air cell 11*b* is intended to change. The fourth set internal pressure is a set internal pressure related to the fourth air cell 11*d* before the internal pressure in the second air cell 11*b* is intended to change. For example, a range may be determined to each of these set internal pressures. When the internal pressure is within the range, the internal pressure is regarded as the set internal pressure.

Hereinafter, an example of the first operation will be described.

Figure 9:
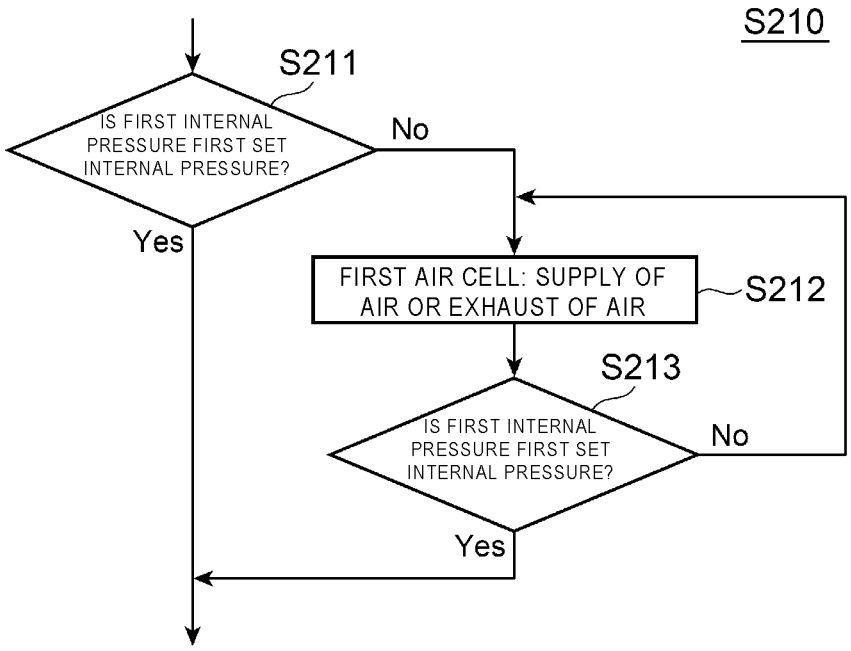
FIG. 9 is a flowchart exemplifying the operation of the air mattress according to the embodiment.

FIG. 9 is a flowchart exemplifying an operation of the air mattress according to the embodiment.

As illustrated in FIG. 9, in the first operation (Step S210), the controller 72 compares the first internal pressure in the first air cell 11*a* with the first set internal pressure (Step S211). If the first internal pressure is the first set internal pressure, the first operation is ended (Step S210), and the operation is shifted to a next operation. For example, the controller 72 shifts the operation to the second operation (Step S220) in which the second internal pressure is changed. The first internal pressure being the first set internal pressure corresponds to the first internal pressure being within the range of the first set internal pressure.

On the other hand, if the first internal pressure is not the first set internal pressure, the controller 72 performs the supply of air or exhaust of air to and from the first air cell (Step S212). Subsequently, the controller 72 compares the first internal pressure in the first air cell 11*a* with the first set internal pressure (Step S213). If the first internal pressure is not the first set internal pressure, the operation returns to Step S212. Such an operation is repeated until the first internal pressure becomes the first set internal pressure.

The third operation and the fourth operation are conducted similarly to the first operation exemplified in FIG. 9.

Hereinafter, an example of the second operation will be described.

Figure 10:
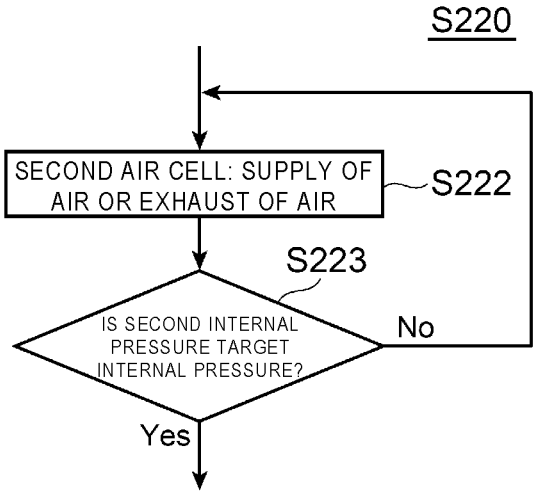
FIG. 10 is a flowchart exemplifying the operation of the air mattress according to the embodiment.

FIG. 10 is a flowchart exemplifying an operation of the air mattress according to the embodiment.

As illustrated in FIG. 10, in the second operation (Step S220), the controller 72 performs the supply of air or exhaust of air with respect to the second air cell 11*b* (Step S222). The controller 72 compares the second internal pressure in the second air cell 11*b* with a target internal pressure of the change (Step S223). If the second internal pressure in the second air cell 11*b* is not the target internal pressure, the operation returns to Step S222. If the second internal pressure in the second air cell 11*b* becomes the target internal pressure, the second operation (Step S220) is ended. For example, a range is determined to the target internal pressure. When the internal pressure is within the range, the internal pressure is regarded as the target internal pressure.

In the second embodiment, the air mattress 110 (see FIG. 1A) may further include the pump unit 31. The pump unit 31 performs the supply and exhaust of air to and from the first air cell 11*a* and the second air cell 11*b*. The pump unit 31 further performs the supply and exhaust of air to and from the third air cell 11*c* and the fourth air cell 11*d*. The controller 72 controls the pump unit 31. Accordingly, the controller 72 conducts the abovementioned first to fourth operations. The air mattress 110 may further include the user interface device 60 that receives an input.

Third Embodiment

Figure 11:
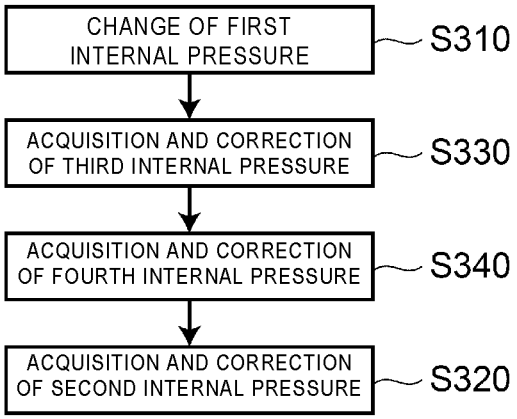
FIG. 11 is a flowchart exemplifying the operation of the air mattress according to the embodiment.

FIG. 11 is a flowchart exemplifying an operation of the air mattress according to the embodiment.

As illustrated in FIG. 11, the controller 72 changes the first internal pressure in the first air cell 11*a* (Step S310). Thereafter, for example, the controller 72 acquires the second internal pressure in the second air cell 11*b*, and corrects, if the second internal pressure is not a second set internal pressure, the second internal pressure such that the second internal pressure becomes the second set internal pressure (Step S320). For example, when changing the first internal pressure in the first air cell 11*a* at the head side, after changing the first internal pressure, the controller 72 sets the second internal pressure in the second air cell 11*b* at the feet side to the second set internal pressure. Accordingly, the discomfort feeling of the user 80 can be reduced.

As illustrated in FIG. 11, between Step S310 and Step S320, the controller 72 may acquire the third internal pressure in the third air cell 11*c*, and correct, if the third internal pressure is not the third set internal pressure, the third internal pressure such that the third internal pressure becomes the third set internal pressure (Step S330).

As illustrated in FIG. 11, between Step S330 and Step S320, the controller 72 may acquire the fourth internal pressure in the fourth air cell 11*d*, and correct, if the fourth internal pressure is not the fourth set internal pressure, the fourth internal pressure such that the fourth internal pressure becomes the fourth set internal pressure (Step S340).

For example, the first internal pressure, the second internal pressure, the third internal pressure, and the fourth internal pressure can be acquired from, for example, the sensor 31*s* (see FIG. 1D).

The embodiments may include the following configurations.

(Configuration 1)

An air mattress provided with: an air cell unit that includes a first air cell block including a plurality of air cells, and a second air cell block including another plurality of air cells; and a controller that independently controls a first internal pressure in the first air cell block and a second internal pressure in the second air cell block.

(Configuration 2)

The air mattress according to Configuration 1, further provided with a third air cell block including another single air cell, in which the controller is capable of controlling an internal pressure in the third air cell block, independently of at least either of the first internal pressure and the second internal pressure.

(Configuration 3)

The air mattress according to Configuration 1 or 2, further provided with a pump unit that performs supply and exhaust of air to and from the plurality of the air cells, in which the controller controls the pump unit.

(Configuration 4)

The air mattress according to any one of Configurations 1 to 3, in which the first air cell block is one of a head block, a shoulder block, a hip block, a buttock block, an upper leg block, and a lower leg block, and the second air cell block is another one of the head block, the shoulder block, the hip block, the buttock block, the upper leg block, and the lower leg block.

(Configuration 5)

The air mattress according to any one of Configurations 1 to 3, in which the first air cell block is one of the hip block and the lower leg block, and the second air cell block is the other of the hip block and the lower leg block.

(Configuration 6)

The air mattress according to any one of Configurations 1 to 3, in which the first air cell block is one of the shoulder block and the hip block, and the second air cell block is the other of the shoulder block and the hip block.

(Configuration 7)

The air mattress according to any one of Configurations 1 to 6, in which the controller is capable of simultaneously controlling internal pressures in all the pluralities of the air cells included in the air cell unit.

(Configuration 8)

The air mattress according to any one of Configurations 1 to 7, further provided with a user interface device that receives an input, in which the controller controls the internal pressure in accordance with the input received by the user interface device.

The embodiments may include the following features.

(Feature 1)

An air mattress including: an air cell unit including a first air cell and a second air cell; and a controller capable of independently controlling a first internal pressure in the first air cell and a second internal pressure in the second air cell, in which the controller performs, when receiving an input to change the second internal pressure, after a first operation to set the first internal pressure to a first set internal pressure determined related to the first air cell, a second operation to change the second internal pressure.

(Feature 2)

The air mattress according to Feature 1, in which in the first operation, the controller compares the first internal pressure with the first set internal pressure, changes, when the first internal pressure is the first set internal pressure, the second internal pressure, and supplies air or exhausts air to and from, when the first internal pressure is not the first set internal pressure, the first air cell to cause the first internal pressure to be the first set internal pressure.

(Feature 3)

The air mattress according to Feature 1 or 2, further comprising a third air cell provided between the first air cell and the second air cell, the controller being capable of controlling a third internal pressure in the third air cell, independently of the first internal pressure and the second internal pressure, and the controller being configured to perform, between the first operation and the second operation, a third operation to cause the third internal pressure to be a third set internal pressure determined related to the third air cell.

(Feature 4)

The air mattress according to Feature 3, further provided with a fourth air cell, in which the fourth air cell is present between the third air cell and the second air cell, the controller is capable of controlling a fourth internal pressure in the fourth air cell, independently of the first internal pressure, the second internal pressure, and the third internal pressure, the controller conducts, between the third operation and the second operation, a fourth operation to cause the fourth internal pressure to be a fourth set internal pressure determined related to the fourth air cell, and the fourth air cell is an air cell for a hip.

(Feature 5)

The air mattress according to Feature 3 or 4, in which the third air cell is an air cell for shoulders.

(Feature 6)

The air mattress according to any one of Features 1 to 5, in which the first air cell is an air cell for a head, and the second air cell is an air cell for buttocks.

(Feature 7)

The air mattress according to any one of Features 1 to 6, in which the air cell unit includes a first end and a second end, a first direction from the first end to the second end is along a direction from the first air cell to the second air cell, a first distance along the first direction between the first end and the first air cell is shorter than a second distance along the first direction between the first end and the second air cell, a third distance along the first direction between the second end and the first air cell is longer than a fourth distance along the first direction between the second end and the second air cell, the third distance is longer than the second distance, and the fourth distance is longer than the first distance.

(Feature 8)

The air mattress according to any one of Features 1 to 7, further provided with a pump unit that performs supply and exhaust of air to and from the first air cell and the second air cell, in which the controller controls the pump unit.

(Feature 9)

The air mattress according to any one of Features 1 to 8, further provided with a user interface device that receives the input.

With the embodiments, a more comfortable air mattress can be provided.

In the foregoing, the embodiments of this disclosure have been described with reference to the specific examples. However, the present invention is not limited to these specific examples. For example, the specific configurations of the respective elements such as the air cell unit and the controller, which are included in the air mattress, can be included in the scope of the present invention, as long as those skilled in the art can similarly implement the present invention by the appropriate selection from the publicly known range, and obtain the similar effects.

The combination of any two or more elements in the specific examples within a technically possible range is included in the scope of the present invention as long as it includes the gist of the present invention.

In addition, all the air mattresses that can be implemented through the design changes as appropriate by those skilled in the art based on the air mattresses described above as the embodiments of the present invention belong to the scope of the present invention as long as the gist of the present invention is included.

In addition, within the spirit of the present invention, those skilled in the art can conceive of various changes and modifications, and it is understood that these changes and modifications also belong to the scope of the present invention.

REFERENCE SIGNS LIST

10 . . . air cell unit, 10*e*, 10*f* . . . first, second end, 11 . . . air cell, 11A . . . head block, 11B . . . shoulder block, 11C . . . hip block, 11D . . . buttock block, 11E . . . upper leg block, 11F . . . lower leg block, 11*a* to 11*d* . . . first to fourth air cells, 11*p* . . . tube, 21 . . . first side edge unit, 22 . . . second side edge unit, 31 . . . pump unit, 31*d* . . . DC pump, 31*s* . . . sensor, 40 . . . upper layer cushion unit, 45L . . . section cover, 45Lf . . . zipper, 45U . . . top cover, 45Uf . . . zipper, 60 . . . user interface device, 61 . . . descending button, 62 . . . ascending button, 64*a* to 64*f* . . . display input units, 65 . . . display, 68 . . . cable, 70 . . . control device, 72 . . . controller, 78 . . . memory, 80 . . . user, 81*a* . . . head part, 81*b* . . . shoulder part, 81*c* . . . hip part, 81*d* . . . buttock part, 81*e* . . . upper leg part, 81*f* . . . lower leg part, 82 . . . shoulder blade-inferior tip, 83 . . . iliac crest protrusion-inferior tip, 110 . . . air mattress, Dt . . . duty ratio, L1 to L4 . . . first to fourth distances, Pi . . . internal pressure, Pr . . . pressure, SigC . . . strength, tm . . . time

The invention claimed is:

1. An air mattress comprising:

an air cell unit including a first air cell and a second air cell, the first air cell being located closer to a head side of the air mattress than the second air cell; and a controller capable of independently controlling a first internal pressure in the first air cell and a second internal pressure in the second air cell, wherein the controller is configured to, when receiving an input to change the second internal pressure without receiving any input to change the first internal pressure, operate to change the first internal pressure and the second internal pressure in order.

2. The air mattress according to claim 1, wherein the controller is configured to:

determine whether the first internal pressure is a first set pressure before changing the second internal pressure; and set the first internal pressure to the first set pressure if the first internal pressure is not the first set pressure.

3. The air mattress according to claim 1, wherein the first air cell corresponds to a head part of a user, and the second air cell corresponds to a buttock part of the user.

4. The air mattress according to claim 1, wherein the air cell unit further includes a third air cell, the first air cell, the third air cell, and the second air cell are arranged in order from the head side of the air mattress to a foot side of the air mattress, and the controller is capable of independently controlling a third internal pressure in the third air cell, and the controller is configured to, when receiving an input to change the second internal pressure, operate to change the first internal pressure, the third internal pressure, and the second internal pressure in order.

5. The air mattress according to claim 4, wherein the controller is configured to:

determine whether the first internal pressure is a first set pressure before changing the second internal pressure; and set the first internal pressure to the first set pressure if the first internal pressure is not the first set pressure.

6. The air mattress according to claim 4, wherein the first air cell corresponds to a head part of the user, the second air cell corresponds to a buttock part of the user, and the third air cell corresponds to a shoulder part of the user.

7. The air mattress according to claim 1, wherein the air cell unit further includes a third air cell and a fourth air cell, the first air cell, the third air cell, the fourth air cell, and the second air cell are arranged in order from the head side of the air mattress to a foot side of the air mattress, and the controller is capable of independently controlling a third internal pressure in the third air cell and a fourth internal pressure in the fourth air cell, and the controller is configured to, when receiving an input to change the second internal pressure, operate to change the first internal pressure, the third internal pressure, the fourth internal pressure, and the second internal pressure in order.

8. The air mattress according to claim 7, wherein the controller is configured to:

determine whether the first internal pressure is a first set pressure before changing the second internal pressure; and set the first internal pressure to the first set pressure if the first internal pressure is not the first set pressure.

9. The air mattress according to claim 8, wherein the controller is configured to:

determine whether the third internal pressure is a third set pressure and whether the fourth internal pressure is a fourth set pressure before changing the second internal pressure;

set the third internal pressure to the third set pressure if the third internal pressure is not the third set pressure; and set the fourth internal pressure to the fourth set pressure if the fourth internal pressure is not the fourth set pressure.

10. The air mattress according to claim 7, wherein the first air cell corresponds to a head part of the user, the second air cell corresponds to a buttock part of the user, the third air cell corresponds to a shoulder part of the user, and the fourth air cell corresponds to a hip part of the user.

11. A method for controlling an air mattress including an air cell unit including a first air cell at a first internal pressure and a second air cell at a second internal pressure, the first air cell being located closer to a head side of the air mattress than the second air cell, the method comprising:

receiving an input to change the second internal pressure; and when receiving the input to change the second internal pressure without receiving any input to change the first internal pressure, independently controlling the first internal pressure and independently controlling the second internal pressure in order.

12. The method according to claim 11, wherein the method further comprises:

determining whether the first internal pressure is a first set pressure before changing the second internal pressure; and setting the first internal pressure to the first set pressure if the first internal pressure is not the first set pressure.

13. The method according to claim 11, wherein the first air cell corresponds to a head part of a user, and the second air cell corresponds to a buttock part of the user.

14. The method according to claim 11, wherein the air cell unit further includes a third air cell, the first air cell, the third air cell, and the second air cell are arranged in order from the head side of the air mattress to a foot side of the air mattress, and the method further comprises independently controlling a third internal pressure in the third air cell after said independently controlling the first internal pressure and before said independently controlling the second internal pressure.

15. The method according to claim 14, wherein the method further comprises:

determining whether the first internal pressure is a first set pressure before changing the second internal pressure; and setting the first internal pressure to the first set pressure if the first internal pressure is not the first set pressure.

16. The method according to claim 14, wherein the first air cell corresponds to a head part of the user, the second air cell corresponds to a buttock part of the user, and the third air cell corresponds to a shoulder part of the user.

17. The method according to claim 11, wherein the air cell unit further includes a third air cell and a fourth air cell, the first air cell, the third air cell, the fourth air cell, and the second air cell are arranged in order from the head side of the air mattress to a foot side of the air mattress, and the method further comprises independently controlling a third internal pressure in the third air cell and a fourth internal pressure in the fourth air cell, after said independently controlling the first internal pressure and before said independently controlling the second internal pressure.

18. The method according to claim 17, wherein the method further comprises:

determining whether the first internal pressure is a first set pressure before changing the second internal pressure; and setting the first internal pressure to the first set pressure if the first internal pressure is not the first set pressure.

19. The method according to claim 18, wherein the method further comprises:

determining whether the third internal pressure is a third set pressure and whether the fourth internal pressure is a fourth set pressure before changing the second internal pressure;

setting the third internal pressure to the third set pressure if the third internal pressure is not the third set pressure; and setting the fourth internal pressure to the fourth set pressure if the fourth internal pressure is not the fourth set pressure.

20. The method according to claim 17, wherein the first air cell corresponds to a head part of the user, the second air cell corresponds to a buttock part of the user, the third air cell corresponds to a shoulder part of the user, and the fourth air cell corresponds to a hip part of the user.

* * * * *